US008398233B2

(12) United States Patent
Niu et al.

(10) Patent No.: US 8,398,233 B2
(45) Date of Patent: Mar. 19, 2013

(54) INKJET RECORDING MEDIUM

(75) Inventors: Bor-Jiunn Niu, San Diego, CA (US); Haigang Chen, San Diego, CA (US); Lokendra Pai, San Diego, CA (US); Sandeep K. Bangaru, San Diego, CA (US); Greg S. Smith, Oceanside, CA (US); Ryan C. Terasaki, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 187 days.

(21) Appl. No.: 13/017,624

(22) Filed: Jan. 31, 2011

(65) Prior Publication Data

US 2012/0194625 A1 Aug. 2, 2012

(51) Int. Cl.
*B41J 2/01* (2006.01)

(52) U.S. Cl. ..... 347/105; 347/101; 428/32.1

(58) Field of Classification Search ..... 347/105, 347/101, 95, 96, 100; 428/195, 32.1
See application file for complete search history.

(56) References Cited

U.S. PATENT DOCUMENTS

| | | | | |
|---|---|---|---|---|
| 5,985,424 | A | 11/1999 | DeMatte et al. | |
| 6,840,992 | B2 | 1/2005 | Glaum et al. | |
| 2002/0171730 | A1* | 11/2002 | Nakahara et al. | 347/105 |
| 2003/0039808 | A1* | 2/2003 | Ichinose et al. | 347/105 |
| 2003/0180478 | A1* | 9/2003 | Fruge et al. | 428/31 |
| 2005/0003113 | A1* | 1/2005 | Chen et al. | 428/32.18 |
| 2005/0008794 | A1 | 1/2005 | Graczyk et al. | |
| 2006/0099328 | A1 | 5/2006 | Waite et al. | |
| 2006/0201644 | A1* | 9/2006 | Hashimoto et al. | 428/32.21 |
| 2008/0182045 | A1* | 7/2008 | Courtenay et al. | 428/32.34 |
| 2008/0245265 | A1 | 10/2008 | Corbelli | |
| 2010/0129639 | A1 | 5/2010 | Icoz et al. | |
| 2010/0215972 | A1 | 8/2010 | Malla et al. | |

* cited by examiner

*Primary Examiner* — Manish S Shah

(57) ABSTRACT

An inkjet recording medium includes a substrate, a base layer disposed on the substrate, and an ink receiving layer disposed on the base layer. The ink receiving layer includes cationically-modified fumed silica having nanoparticles of alumina and/or silica mixed therein. The alumina nanoparticles have an individual particle size ranging from about 15 nm to about 50 nm, and the silica nanoparticles have an individual particle size ranging from about 5 nm to about 45 nm.

16 Claims, 5 Drawing Sheets

INKJET RECORDING MEDIUM

BACKGROUND

The present disclosure relates generally to inkjet recording mediums.

Media suitable for use with inkjet printing often include one or more porous coating layers to enhance various properties including printing performance and ink quality, to name a couple. In some instances, the properties of the coating layer(s) may be dependent, at least in part, upon drying conditions used during manufacturing of the media. In some instances, the drying conditions may affect the structure of the layer(s), which may ultimately affect the quality of a print.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1A:
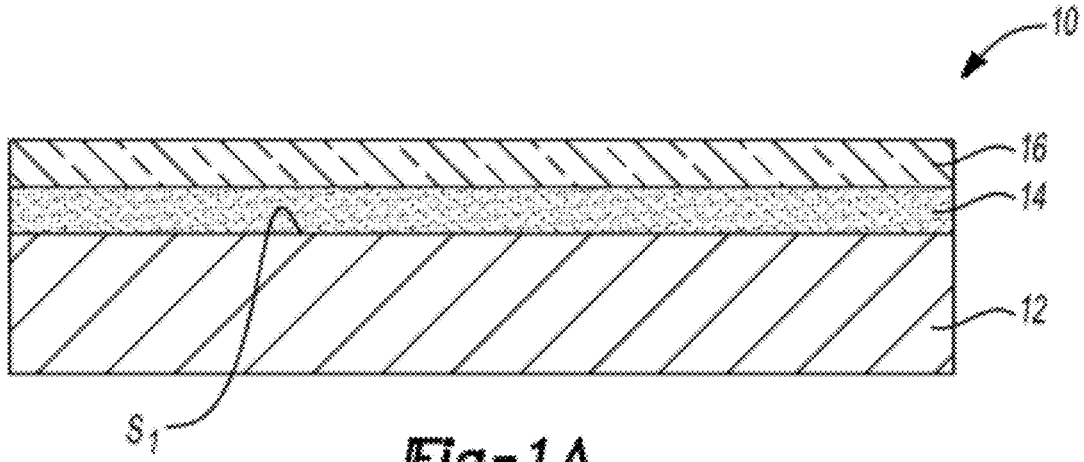
FIGS. 1A, 1B, and 1C are schematic cross-sectional views (which are not drawn to scale) of an inkjet recording medium according to examples disclosed herein.

Coated media are often manufactured by depositing one or more thin layers of a coating material onto a substrate surface. The coating is typically applied on the substrate surface through aqueous coating or solution coating. Some examples of suitable coating methods include rod coating, blade coating, roll coating, dip coating, cast coating, curtain coating, slot-die coating, gravure coating, and/or the like. After the coating is applied, the media is exposed to various drying zones having controlled temperature and air velocity for a prescribed amount of time to remove water or solvent, and the drying results in a coating layer formed on the substrate surface. In some cases, drying is considered to be accomplished when the moisture content of the coating layer ranges from about 4% to about 7%.

It is to be understood that the properties of the internal structure of the coating layer (which may include, e.g., internal voids, surface micro-cracks, etc.) are highly dependent on the drying profile or conditions utilized during manufacturing of the media. The drying profile generally represents how fast water or other solvents is/are removed from the coating layer (s) during the drying stage of the manufacturing process. In some cases, voids internal to the coating structure become larger and/or the surface roughness of the media increases (which may be due, at least in part, to surface cracks) when the drying rate becomes faster. In an example, the drying rate is the amount of water evaporated at a unit of time and area during the drying stage of the manufacturing process. In terms of harsh drying conditions, which will be defined and described in further detail below, the drying rate is equal to or greater than about 4 $g/(m^2 \cdot sec)$.

As previously mentioned, the internal structure of an individual coating layer may, in some cases, be dependent, at least in part, on the conditions utilized during the drying of the layer disposed on the substrate. For instance, large voids may form inside the coating layer (e.g., throughout the thickness of the coating layer) during harsh drying conditions. In an example, the large voids may have an effective diameter of about 0.2 microns to about 2 microns. The presence of the large voids in the layer may increase the porosity of the coating layer and decrease the coating density of the layer. In an example, a coating layer having these voids may have a coating density that is relatively low (such as, e.g., 0.6 g/cc or lower).

In some instances, the voids present in the layer(s) of the coated media may deleteriously affect the image quality of a print (e.g., which is formed when an ink is printed on the media). For dye-based inks, for example, the dye molecules may penetrate into any voids formed at least in the outermost coating layer of the media, which may cause the image to appear more opaque than desired. The penetration of the dye molecules in the voids may also subject the media to undesirably larger amounts of light scattering, which may also cause the image to appear hazy. Additionally, the presence of the voids in the coating layer(s) may render the media as being more susceptible to surface cracking or micro-cracking which may occur during drying of the media. This may deleteriously affect at least the integrity and/or print quality of the media.

Examples of the inkjet recording medium disclosed herein include a porous coating layer that is absent of large voids in its internal coating structure, and has a coating density of 0.7 g/cc or more. This advantageously improves image quality of a print formed by printing a dye-based ink on the medium. In some instances, the color gamut of the print is increased by 30% or more, and the haze of the print is significantly reduced (i.e., when the L*Min is reduced to or below a black point value above which the print degrades into shades of gray. In an example, for an inkjet writing system including black dye-based inks, an L*min at or below 10 is generally considered a good black point. In another example, for an inkjet writing system lacking black dye-based inks, an L*min at or below 30 is generally considered a good black point).

Figure 1B:
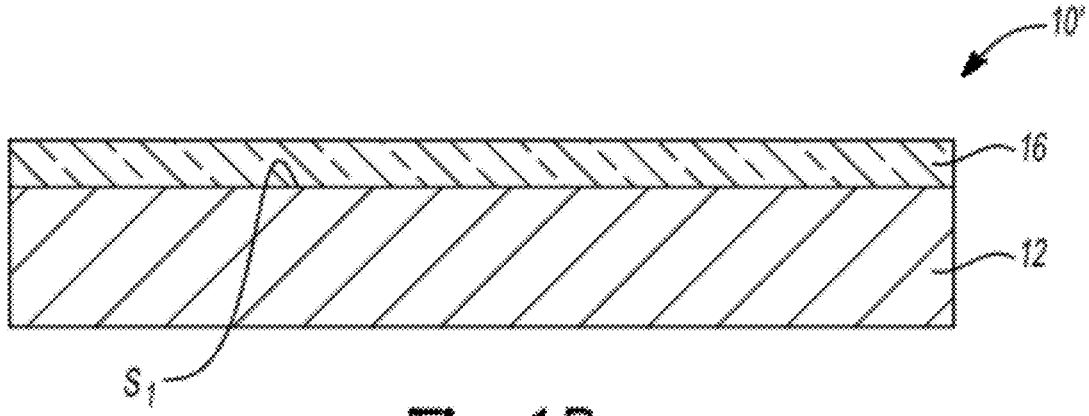
Figure 1C:
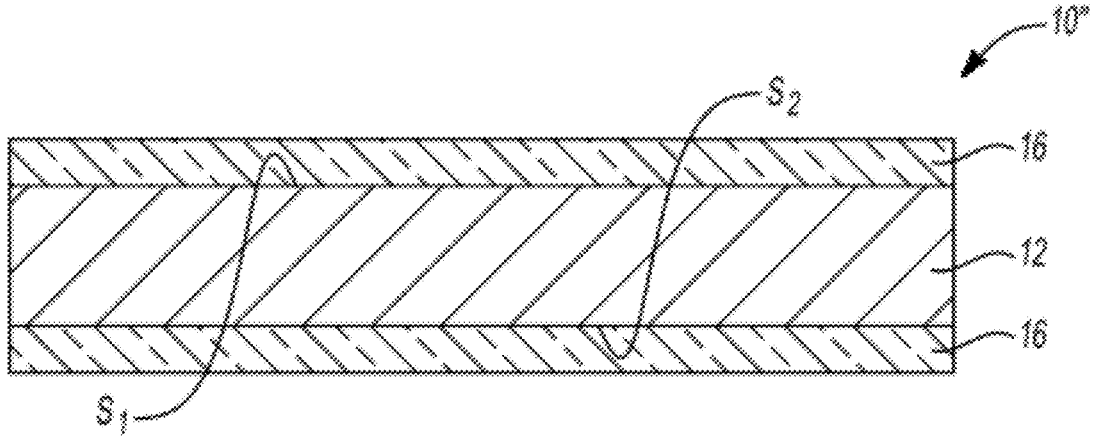

Examples of the inkjet recording medium are schematically depicted in FIGS. 1A through 1C. One of these examples is shown in FIG. 1A, and the medium 10 in this example includes a substrate 12, a base layer 14 disposed on a single surface $S_1$ of the substrate 12, and an ink receiving layer 16 disposed on the base layer 14. Another example is shown in FIG. 1B, and the medium 10' in this example includes a substrate 12 and an ink receiving layer 16 disposed on the substrate 12 (e.g., on the surface $S_1$). In this latter example, the medium 10' does not include a base layer 14. FIG. 1C depicts an example of the medium 10", which includes the substrate 12 having an ink receiving layer 16 disposed on opposed surfaces $S_1$, $S_2$ of the substrate 12. Although not shown in the figures, it is to understood that the medium 10" may include a base layer between one of the surfaces of the substrate 12 (e.g., the surface $S_1$) and the ink receiving layer 16, or between both of the surfaces $S_1$ and $S_2$ and their respective ink receiving layers 16.

It is further to be understood that, for any of the examples disclosed herein, the base layer 14 may include a single base layer, or multiple base layers (e.g., two or more layers). Further, the ink receiving layer 16 may include a single ink receiving layer, or multiple ink receiving layers (e.g., two or more ink receiving layers).

It is to be understood that, as used herein, the terms "disposed on", "deposited on", "established on", and the like are broadly defined herein to encompass a variety of divergent layering arrangements and assembly techniques. These arrangements and techniques include i) the direct attachment of one material layer to another material layer with no intervening material layers therebetween, and ii) the attachment of one material layer to another material layer with one or more material layers therebetween, provided that the one layer being "disposed on", "deposited on", or "established on" the other layer is somehow supported by the other layer (notwithstanding the presence of one or more additional material layers therebetween).

Further, the phrases "disposed directly on", "deposited directly on", "established directly on" and/or the like are broadly defined herein to encompass a situation(s) wherein a given material layer is secured to another material layer without any intervening material layers therebetween. Any statement used herein which indicates that one layer of material is on another layer is to be understood as involving a situation wherein the particular layer that is "on" the other layer in question is the outermost of the two layers relative to incoming ink materials being delivered by the printing system of interest. It is to be understood that the characterizations recited above are to be effective regardless of the orientation of the recording medium materials under consideration.

The substrate 12 for the medium 10, 10', 10" may be chosen from any cellulose-based paper, i.e., paper that includes cellulose fibers. For instance, the substrate 12 may be made from pulp fibers derived from hardwood trees (e.g., deciduous trees (angiosperms) such as birch, oak, beech, maple, and eucalyptus) and/or softwood trees (e.g., coniferous trees (gymnosperms) such as varieties of fir, spruce, and pine, as for example loblolly pine, slash pine, Colorado spruce, balsam fir and Douglas fir), and these pulps may be prepared via any known pulping process. Further, the cellulose-based paper may include one or more fillers to control the physical properties of the substrate 12. Examples of fillers include ground calcium carbonate, precipitated calcium carbonate, titanium dioxide, kaolin clay, silicates, and combinations thereof. It is to be understood that the cellulose-based paper may be referred to herein as plain paper.

Other examples of the substrate 12 include resin-coated papers (such as, e.g., photobase paper) and papers made from or including polyethylene (PE), polypropylene (PP), polyethylene terephthalate (PET), polylactic acid (PLA), and/or the like, and/or combinations thereof. In an example, the substrate 12 is formed from cellulose papers, papers including synthetic fibers, polymeric films, or combinations thereof.

In instances where a base layer is incorporated into the medium (such as the example of the medium 10 shown in FIG. 1A), the base layer 14 may be disposed on one or more surfaces (such as the surface $S_1$) of the substrate 12. In an example, the base layer 14 is formed from a mixture of pigments and binders. Examples of pigments for the base layer 14 include kaolin clay, ground calcium carbonate, precipitated calcium carbonate, silica, plastic pigments (e.g., non-film-forming synthetic hollow-sphere opaque polymeric pigments commercially available under the tradename Ropaque™ Ultra from The Dow Chemical Co., Midland, Mich.), and/or combinations thereof. Some examples of binders that may be used for the base layer 14 include polystyrene latex, polystyrene-butadiene copolymer latex, acrylic latex, cellulose, polyvinyl alcohol, and/or combinations thereof. In one example, the base layer 14 includes a mixture of ground calcium carbonate, precipitated calcium carbonate, kaolin clay, plastic pigments, and a binder.

In some examples, a single base layer 14 is disposed on one or more surfaces of the substrate 12. In other examples, there may be two or more base layers 14 disposed on one or more surfaces of the substrate 12.

The ink receiving layer 16 of the inkjet recording medium 10, 10', 10" (shown in FIGS. 1A, 1B, and 1C, respectively) is a porous layer that is disposed on the base layer 14 (shown in FIG. 1A) or on the substrate 12 (shown in FIGS. 1B and 1C). The ink receiving layer 16 generally includes a first pigment having nanoparticles of a second pigment mixed therein. In an example, the first pigment is chosen from cationically-modified fumed silica, and the second pigment is chosen from nanoparticles of silica and/or alumina. Without being bound to any theory, it is believed that the silica and/or alumina nanoparticles reduce or even eliminate the large voids formed in the ink receiving layer 16 when the layer 16 is exposed to harsh drying conditions during manufacturing of the medium 10, 10', 10". As used herein, the term "drying conditions" refer to the conditions to which the medium 10, 10', 10" is exposed to dry the ink receiving layer(s) 16. "Harsh drying conditions" include i) exposing the medium 10, 10', 10" to a temperature greater than 100° C., ii) exposing the medium 10, 10', 10" to this temperature for less than 15 seconds while the moisture content of the layer 16 falls within the range of about 4% to about 7%, and iii) the water evaporation rate is equal to or greater than about 4 $g/(m^2 \cdot sec)$. In an example, the coating on the medium may be formed upon being exposed to harsh drying conditions as described immediately above.

In contrast, "mild drying conditions" refer to drying conditions where the medium 10, 10', 10" is i) exposed to a temperature below 100° C., ii) drying is accomplished (i.e., where the moisture content of the ink receiving layer(s) 14 falls within the range of about 4% to about 7%) for greater than 15 seconds, and iii) the water evaporation rate is less than about 4 $g/(m^2 \cdot sec)$. In an example, the medium 10, 10', 10" is exposed to mild drying conditions when i) the drying temperature is no greater than 60° C., and ii) the drying time is at least 85 seconds.

In an example, the cationically-modified fumed silica may be obtained through a chemical reaction between fumed silica, aluminum chlorohydride, and organic silane at a reaction temperature ranging from about 60° C. to about 70° C. for about 70 minutes. Examples of the fumed silica that may be used for the reaction include CAB-O-SIL® M-5 and CAB-O-SIL® MS-55 (both of which are available from Cabot Corp. (Boston, Mass.)), AEROSIL® 200 and AEROSIL® 250 (both of which are available from Evonik Industries (Parsippany, N.J.)), ORISIL® 200 (available from Orisil, Ltd. (Ukraine)), and/or combinations thereof. Examples of the aluminum chlorohydride include LOCRON® P (available from Clariant (Charlotte, N.C.)) and aluminum hydroxychloride (available from Nalco Co. (Naperville, Ill.)). The organic silane may be chosen from Organosilane A301 (available from China Onichem Specialities Co., Ltd. (Dalian, China)) and SILQUEST® A-1120 (available from GE Advanced Materials (Wilton, Conn.)).

The fumed silica chosen for the first pigment of the ink receiving layer 16, prior to being cationically-modified, may be a powder form of amorphous silicon dioxide that is fused into branched, chain-like secondary particles. These particles may, in some instances, aggregate or agglomerate into tertiary particles. In an example, the fumed silica has an individual particle size (or effective diameter, noting that the particles may not be perfectly spherically shaped) ranging from about 5 nm to about 80 nm, and an aggregated particle size ranging from about 80 nm to about 500 nm. In another example, the fumed silica has an individual particle size ranging from about 10 nm to about 50 nm, and an aggregated particle size ranging from about 100 nm to about 250 nm. The surface area of the fumed silica particles ranges from about 150 $m^2/g$ to about 350 $m^2/g$. It is to be understood that the foregoing ranges for the size and surface area applies for both fumed silica and cationically-modified fumed silica, at least in part because the cationic modification of the fumed silica changes the size and surface area of the fumed silica minimally, if at all. Further, the fumed silica, when it has been cationically-modified, has a zeta potential ranging from about 20 mV to about 50 mV and, in some cases, from about 30 mV to about 45 mV.

As previously mentioned, the second pigment of the ink receiving layer 16 may be chosen from nanoparticles of alumina or silica. It is believed that, in some instances, the second pigment may be chosen from a mixture of alumina nanoparticles and silica nanoparticles. In instances where silica nanoparticles are mixed in the cationically-modified fumed silica, the silica nanoparticles may be chosen from cationically-modified, amorphous colloidal silica, which has a surface area ranging from about 100 $m^2/g$ to about 150 $m^2/g$. In another example, the surface area of the silica nanoparticles ranges from about 110 $m^2/g$ to about 130 $m^2/g$. In yet another example, the silica nanoparticles have a surface area of about 120 $m^2/g$. Further, the individual particle size (or effective diameter, noting that the silica nanoparticles may not be perfectly spherically shaped) of the silica nanoparticles ranges from about 5 nm to about 45 nm and, in some cases, from about 10 nm to about 30 nm. In another example, the size of the silica nanoparticles ranges from about 15 nm to about 25 nm. In an example, the silica nanoparticles may be chosen from CARTACOAT® K302C (Clariant, Charlotte, N.C.), and these silica particles have an average individual particle size of about 20 nm and an average surface area of about 120 $m^2/g$.

In instances where alumina nanoparticles are mixed with the cationically-modified fumed silica, the alumina nanoparticles may be chosen from alumina pigment having a crystallite size (i.e., the length of the crystallite of the alumina pigment) ranging from about 10 nm to about 30 nm and, in some cases, from about 10 nm to about 20 nm. In an example, the alumina nanoparticles have an individual particle size (or effective diameter, noting that the alumina nanoparticles may not be perfectly spherically shaped) ranging from about 15 nm to about 50 nm, and an aggregated particle size ranging from about 100 nm to about 300 nm. In another example, the alumina nanoparticles have an individual particle size ranging from about 15 nm to about 40 nm, and an aggregated particle size ranging from about 120 nm to about 200 nm. The surface area of the alumina nanoparticles ranges from about 150 $m^2/g$ to about 200 $m^2/g$. The alumina nanoparticles may be chosen, for example, from DISPERAL® HP14 (Sasol, Ltd. (Houston, Tex.)), and these alumina particles have an average primary particle size of about 35 nm and an average aggregated particle size of about 170 nm. Furthermore, the alumina nanoparticles may have a surface area ranging from about 150 $m^2/g$ to about 200 $m^2/g$.

In an example, the cationically-modified fumed silica is present in the ink receiving layer 16 in an amount ranging from about 70 wt % to about 90 wt % of the total amount of pigment present in the layer 16, and the silica nanoparticles are present in an amount ranging from about 10 wt % to about 30 wt % of the total amount of pigment present in the layer 16. In another example, the fumed silica is present in the ink receiving layer 16 in an amount ranging from about 80 wt % to about 90 wt % of the total amount of pigment present in the layer 16, and the silica nanoparticles are present in an amount ranging from about 10 wt % to about 20 wt % of the total amount of pigment present in the layer 16. In still another example, the fumed silica is present in the ink receiving layer 16 in an amount ranging from about 60 wt % to about 90 wt % of the total amount of pigment present in the layer 16, and the alumina nanoparticles are present in an amount ranging from about 10 wt % to about 40 wt % of the total amount of pigment present in the layer 16. In yet a further example, the fumed silica is present in the ink receiving layer 16 in an amount ranging from about 70 wt % to about 85 wt % of the total amount of pigment present in the layer 16, and alumina nanoparticles are present in an amount ranging from about 15 wt % to about 30 wt % of the total amount of pigment present in the layer 16.

In another example, the ink receiving layer 16 further includes one or more surfactants, a humectant, one or more binders, and/or a cross-linking agent. In some instances, the ink receiving layer 16 further includes one or more slip aids.

The surfactant(s) is/are generally used in the ink receiving layer 16 to facilitate the manufacturing process of the media, e.g., by providing surface tension of the solution (e.g., ranging from about 25 dynes/cm to about 35 dynes/cm), and further, by maintaining stable curtain stability during curtain coating processes. In an example, the surfactant is chosen from nonionic surfactants, some examples of which include ethoxylated acetylenic diols (such as DYNOL™ 607 or DYNOL™ 603 (Air Products and Chemicals, Inc., Lehigh Valley, Pa.)), alkoxylated alcohols (such as TEGO® WET 510 (Evonik Tego Chemie GmbH, DE)), and/or combinations thereof. The surfactant may also or otherwise be chosen from a fluorosurfactant such as, e.g., ZONYL® FSO (DuPont (Wilmington, Del.)). In an example, the surfactant is present in an amount ranging from about 0.1 wt % to about 0.3 wt % of the ink receiving layer 16.

The humectant is also used in the ink receiving layer 16 to facilitate the manufacturing process of the media, e.g., by slowing down the water evaporation rate and avoiding surface cracks that may occur during drying. Some examples of humectants that may be used include glycerol, diethylene glycol mono butyl ether (such as those produced by J. T. Baker (Phillipsburg, N.J.)), and/or combinations thereof. In an example, the humectant is present in an amount ranging from about 0.5 wt % to about 1.5 wt % of the ink receiving layer 16.

As previously mentioned, the ink receiving layer 16 may further include a binder, which may be used to hold the pigment particles (e.g., the mixture of the fumed silica and the silica and/or alumina nanoparticles) of the ink receiving layer 16 together. The binder may be chosen from polyvinyl alcohol (such as POVAL® PVA 235 and MOWIOL® 40-88 (Clariant, Charlotte, N.C.)), cationically-modified polyvinyl alcohol, polyethylene oxide-modified polyvinyl alcohol, acetoacetyl-modified polyvinyl alcohol, polyethylene-co-polyvinyl alcohol, polyvinyl acetate, polyvinyl pyrrolidone, and/or combinations thereof. In an example, the binder may be present in an amount ranging from about 10 wt % to about 20 wt % of the ink receiving layer 16.

In an example, the ink receiving layer 16 further includes a cross-linking agent to cross-link the binders present in the layer 16. In one example, the cross-linking agent is chosen from boric acid, and is present in an amount ranging from about 2 wt % to about 3 wt % of the ink receiving layer 16.

The ink receiving layer 16 may further include a slip aid configured to reduce sheet-to-sheet friction and to improve the scratch resistance of the medium 10, 10', 10". Examples of a slip aid that may be used include polyethylene (such as SLIP-AYD® SL 1618 (Elementis Specialties (Hightstown, N.J.)), a polyamide (such as ORGASOL® 2002 ES3 NAT 3 (Arkema Inc., Philadelphia, Pa.)), high density polyethylene (such as ULTRALUBE® E846 (Keim-Additec Surface GmbH, DE)), and/or combinations thereof. The slip aid may be present in an amount ranging from about 1 wt % to about 2 wt % of the ink receiving layer 16.

In an example, the coat weight of the ink receiving layer 16 ranges from about 10 gsm to about 30 gsm.

The inkjet recording medium 10 (shown in FIG. 1A) may be made by forming the base layer 14 on the substrate 12 (such as on the substrate surface $S_1$), and then forming the ink receiving layer 16 on the base layer 14. In this example, the base layer 14 may be formed by mixing the base layer components together and then depositing the mixture onto the substrate surface $S_1$. In an example, the components are mixed together by adding the components into a mixing tank, and then mixing the components together using a mixing blade for about an hour. Mixing may be accomplished, for example, at a mixing speed of about 200 rpm. The mixture may be applied to the surface $S_1$ using any suitable process, including roll-coating, conventional slot-die processing, blade coating, slot-die cascade coating, curtain coating, and/or other comparable methods including those that use circulating and non-circulating coating techniques. In some instances, spray-coating, immersion-coating, and/or cast coating techniques may also be used.

The ink receiving layer 16 may be formed on the base layer 14 by mixing the ink receiving layer components together (e.g., in a mixing tank with a mixing blade), and then depositing the mixture to the base layer 14. The mixture of the ink receiving layer components is deposited on the base layer 14 using any of the methods identified above for depositing the base layer 14 on the substrate 12.

The inkjet recording medium 10' (shown in FIG. 1B) may be made by forming the ink receiving layer 16 directly onto the surface $S_1$ of the substrate 12, whereas the inkjet recording medium 10" (shown in FIG. 1C) may be made by forming one ink receiving layer 16 directly onto the surface $S_1$ of the substrate 12 and forming another ink receiving layer 16 directly onto the opposed surface $S_2$ of the substrate 12. Thus, in these examples, no base layer is formed between the layers 12 and 16. The forming of the ink receiving layer 16 onto the substrate 12 may be accomplished using the same method described above for forming the ink receiving layer 16 on the base layer 14.

For either of the methods described above, the forming of the ink receiving layer 16 on the base layer 14 (for making the medium 10) or on the substrate 12 (for making the medium 10', 10") includes drying the layer(s) 14, 16 by exposing the medium 10, 10' to heat. In an example, heating is accomplished using harsh heating conditions (such as during manufacturing of the medium), whereby the medium 10, 10', 10" is exposed to a temperature greater than 100° C. for less than 15 seconds, and the water evaporation rate is equal to or greater than about 4 g/($m^2$·sec). Heating may be accomplished using a hot air dryer, or in some cases, an infrared (IR) dryer. For instance, drying may be accomplished by exposing the medium 10, 10', 10", as a moving web, to heat zones with moving air during the manufacturing process. The temperature of the drying zones and the air velocity are controlled in order to control the drying (e.g., to create harsh drying conditions, mild drying conditions, etc.).

Upon drying the layer(s) 14, 16, the silica and/or alumina nanoparticles reduce or eliminate the voids formed in the ink receiving layer 16 as a result of the harsh drying conditions mentioned above. The reduction or elimination of the voids may be the result of the nanoparticles filling the voids, which advantageously increases the coating density of the layer 16 from 0.6 g/cc or lower (where voids would be present) to 0.7 g/cc or higher (where the voids are filled). In some instances, the coating density is improved to at least 0.8 g/cc with the presence of the silica and/or alumina nanoparticles in the ink receiving layer. Further, the increase in coating density advantageously improves the image quality (e.g., in terms of color gamut and L*Min) of a print produced by printing an ink on the medium 10, 10'. In an example, the color gamut of the print ranges from about 300,000 to about 350,000, and the L*Min of the print ranges from about 25 to about 30.

To briefly reiterate, the instant disclosure has been described above for providing a coated medium that is absent of large voids in the internal structure of the coating layer(s) to prevent the penetration of dye molecules from getting trapped inside the voids. It is to be understood, however, that the examples of the inkjet recording medium disclosed herein also improve at least the image quality of a print formed by printing pigment-based inks on the medium. For instance, the reduction in the large voids and/or reduction or elimination of surface cracking and/or micro-cracking in the coating layer (s) may prevent pigment particles from getting trapped inside the coating layer which could deleteriously affect at least the image quality of the print.

Figure 2:
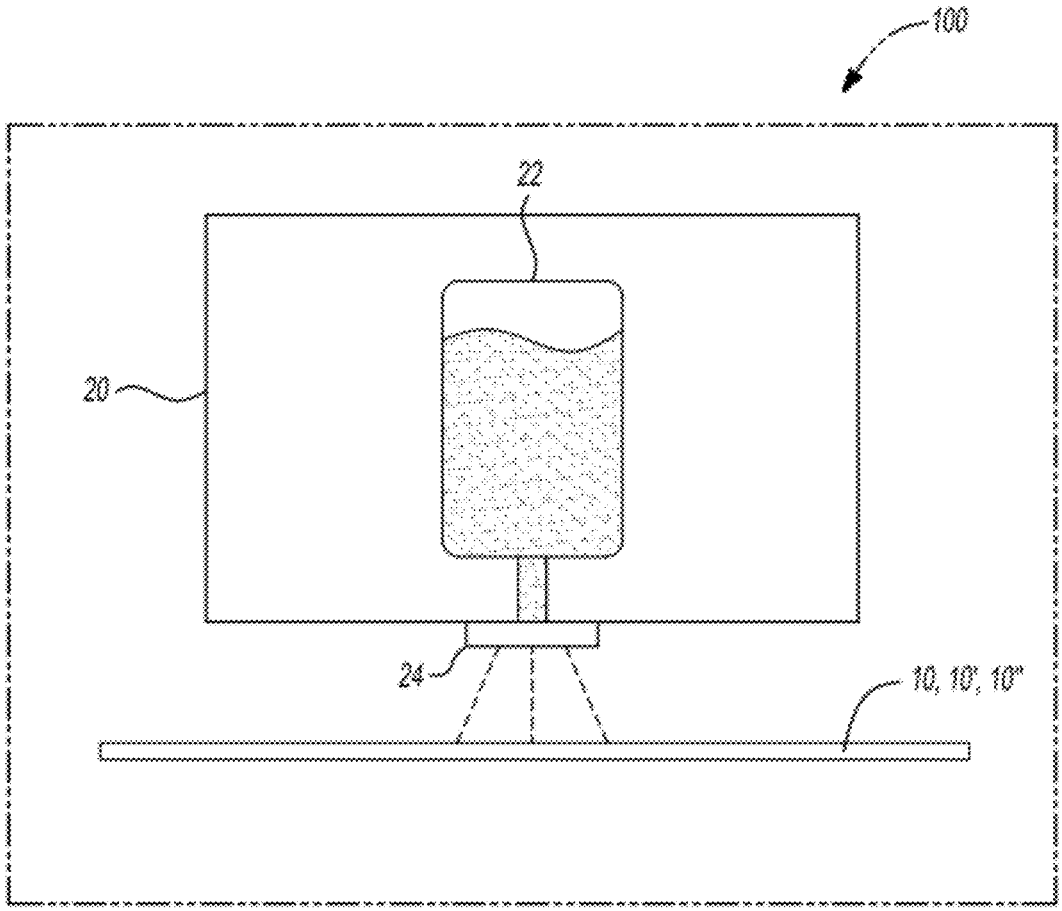
FIG. 2 is a schematic illustration of an example of an inkjet recording system that may be used to deposit an ink onto an inkjet recording medium.

Also disclosed herein is an inkjet recording system 100, an example of which is schematically shown in FIG. 2. In this example, the system 100 includes an inkjet printing system or device 20 (such as, e.g., a continuous device, a drop-on-demand device, a thermal inkjet (TIJ) device, or a piezoelectric inkjet device) having at least one inkjet fluid ejector 24. Upon retrieving the ink from an ink chamber 22 during printing, the fluid ejector 24 is configured to eject an ink onto the medium 10, 10', 10" to form a print.

To further illustrate the present disclosure, examples are given herein. It is to be understood that these examples are provided for illustrative purposes and are not to be construed as limiting the scope of the disclosure.

EXAMPLES

Three samples of a medium were prepared by coating a paper substrate with a coating material to form a base layer, and coating the base layer with a coating material to form a porous ink receiving layer thereon. The first sample was prepared as a comparative sample, which included cationically-modified fumed silica (CAB-O-SIL® M-5) without nanoparticles of alumina or silica mixed therein. One of the remaining samples (Sample A) included the cationically-modified fumed silica (CAB-O-SIL® M-5) and alumina nanoparticles (DISPERAL® HP14, available from Sasol, Ltd. (Houston, Tex.)). The last sample (Sample B) included the cationically-modified fumed silica (CAB-O-SIL® M-5) and silica nanoparticles (CARTACOAT® K302C). The respective mediums were prepared by applying the base layer onto the paper substrate, and then the ink receiving layer onto the base layer via a Meyer rod or a curtain coating process. The specific formulations of these samples are set forth in Table 1 below:

TABLE 1

Compositions of the ink receiving layer

| | Comparative Sample (dry wt, g) | Sample A (dry wt, g) | Sample B (dry wt, g) |
|---|---|---|---|
| Cationically-modified fumed silica | 100 | 80 | 90 |
| Alumina nanoparticles | | 20 | |
| Silica nanoparticles | | | 10 |
| Surfactant | 0.3 | 0.3 | 0.3 |
| Humectant | 1 | 1 | 1 |
| Binder | 18 | 18 | 18 |
| Cross-linking Agent | 2.6 | 2.6 | 2.6 |
| Slip aid | 1 | 1 | 1 |

The formulations set forth in Table 1 are used for all of the Examples provided below.

Example 1

The three samples were dried using various drying conditions. In Examples 1 through 10 in Table 2 below, the samples were dried using a heat gun or a dryer. The heating conditions used for drying the Samples (e.g., the maximum heating temperature and the maximum web temperature (both measured in ° C.) and the dwelling time (seconds)), the drying rate (calculated in $g/m^2 \cdot sec$, which was determined by dividing the amount of water evaporated by the dwell time), and a drying condition classification (e.g., mild drying conditions or harsh drying conditions) are also provided in Table 2.

TABLE 2

Drying conditions for the Comparative Sample, Sample A, and Sample B

| | Comparative Sample | | | | | Sample A | | | Sample B | |
|---|---|---|---|---|---|---|---|---|---|---|
| Example No. | 1 | 2 | 3 | 4 | 5 | 6 | 7 | 8 | 9 | 10 |
| Max Heat Temp (° C.) | 55 | 60 | 145 | 175 | 138 | 55 | 170 | 138 | 55 | 138 |
| Max Web Temp (° C.) | 40 | 55 | 60 | 98 | 60 | 40 | 80 | 60 | 40 | 60 |
| Dwell Time (seconds) | 120 | 85 | 9 | 6.5 | 13 | 120 | 6.5 | 13 | 120 | 13 |
| Drying Rate ($g/m^2 \cdot sec$) | 0.53 | 0.75 | 7.11 | 9.85 | 4.92 | 0.53 | 9.85 | 4.92 | 0.53 | 4.92 |
| Coating Method | Meyer rod | Curtain | Curtain | Curtain | Meyer rod | Meyer rod | Curtain | Meyer rod | Meyer rod | Meyer rod |
| Drying Method | Heat gun | Dryer | Dryer | Dryer | Dryer | Heat gun | Dryer | Dryer | Heat gun | Dryer |
| Drying Conditions | Mild | Mild | Harsh | Harsh | Harsh | Mild | Harsh | Harsh | Mild | Harsh |

Figure 3:
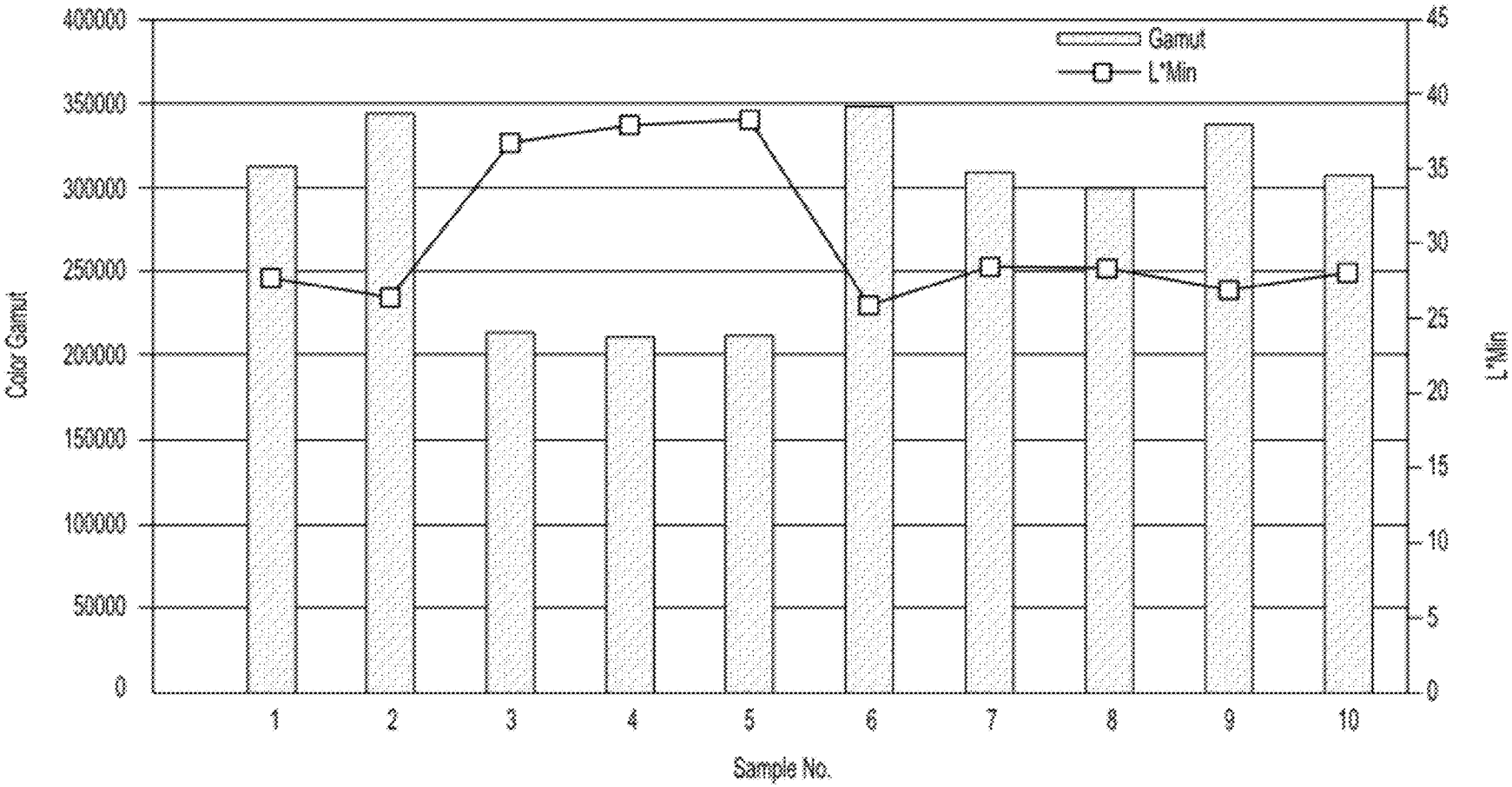
FIG. 3 is a graph showing the effect of drying conditions used when making an inkjet recording medium on the image quality (gamut and L*Min) of a print.

Each of the Samples of the medium (as represented by Examples 1 through 10 in Table 2 above) were used to form a print by printing a dye-based ink (not containing a black dye ink) onto the medium. Printing was accomplished using an HP Officejet K5400 printer (Hewlett-Packard Co.) using a brochure glossy normal printing mode at ambient conditions of about 23° C. and about 50% relative humidity. The ink quality in terms of color gamut and L*Min were measured for each example about 24 hours after printing. More specifically, the color gamut was measured from eight colors (e.g., black (generally created by mixing color dyes from cyan, magenta and yellow), cyan, magenta, yellow, red, blue, green, and white) using an X-Rite 938 spectrodensitometer with a light source of D65 and a view angle of 2°. The gamut was calculated from the L*, a*, and b* values of the eight colors. Further, L*Min was measured using the X-Rite spectrodensitometer with the light source of D65 and the view angle of 2°. The results are shown in FIG. 3. Desirable image quality is achieved when the color gamut is greater than about 300,000, and the L*Min is lower than about 30.

Example 2

As shown in FIG. 3, the print formed using the medium of the Comparative Sample (i.e., the sample that did not include nanoparticles mixed with the fumed silica) had a high color gamut, and a low L*Min, which is indicative of good image quality under mild drying conditions (Examples 1 and 2). Under harsh drying conditions (as shown by Examples 3 through 5 in FIG. 3), the image quality worsens in that the color gamut falls significantly below 300,000 and the L*Min is much higher than 30. In contrast, the addition of the alumina nanoparticles in the ink receiving layer of the medium (i.e., Sample A; Examples 6 through 8 in FIG. 3) shows that image quality is good in both mild and harsh drying conditions. The same result occurs for the medium including the silica nanoparticles in the ink receiving layer (i.e., Sample B; Examples 9 and 10 in FIG. 3).

Example 3

The average coating density (in g/cc) was also determined for Examples 1 through 10 described above from the ratio of the coating thickness (taken, e.g., from the SEM images shown in FIGS. 4A, 4B, 5A, and 5B) and the measured coating weight. These results are shown in Table 3 below:

TABLE 3

Coating density (g/cc) for Examples 1 through 10

| Example | Drying Conditions | Coating Density (g/cc) |
|---|---|---|
| 1 | Mild | 0.72 |
| 2 | Mild | 0.84 |
| 3 | Harsh | 0.57 |
| 4 | Harsh | 0.57 |
| 5 | Harsh | 0.65 |
| 6 | Mild | 0.82 |
| 7 | Harsh | 0.70 |
| 8 | Harsh | 0.70 |

TABLE 3-continued

| Coating density (g/cc) for Examples 1 through 10 | | |
|---|---|---|
| Example | Drying Conditions | Coating Density (g/cc) |
| 9 | Mild | 0.75 |
| 10 | Harsh | 0.71 |

As shown in Table 3, the coating density for Samples A and B under harsh drying conditions (i.e., Examples 7, 8, and 10) was significantly higher than that of the Comparative Sample under harsh drying conditions (i.e., Examples 3 through 5). These results are consistent with the theory that, under harsh drying conditions, large voids formed in the cationically-modified fumed silica are filled with the silica nanoparticles (such as in Example 10) or with the alumina nanoparticles (such as in Examples 7 and 8). The results set forth in Table 3 also show that under mild drying conditions, all of the Samples have a coating density remains high (e.g., of at least 0.7 g/cc). This is based, at least in part, on the theory that the large voids in the fumed silica are not formed during drying under mild conditions.

Example 4

Figure 4A:
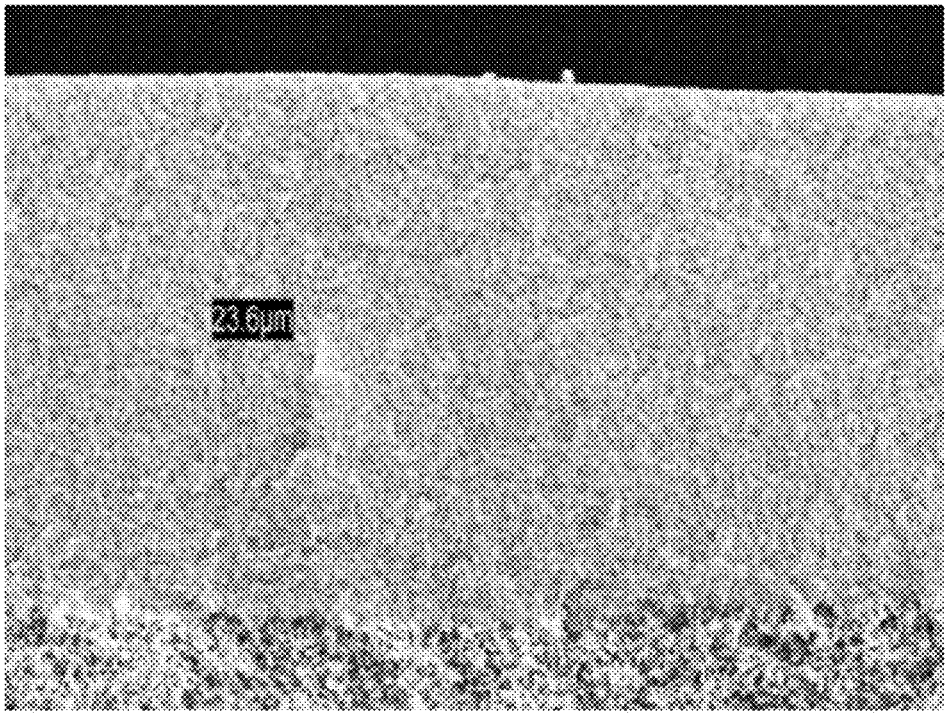
FIGS. 4A and 4B are scanning electron micrograph (SEM) images each showing a cross-section of an ink receiving layer that does not include pigment nanoparticles, where the ink receiving layer was made under mild drying conditions (FIG. 4A) and under harsh drying conditions (FIG. 4B)
Figure 4B:
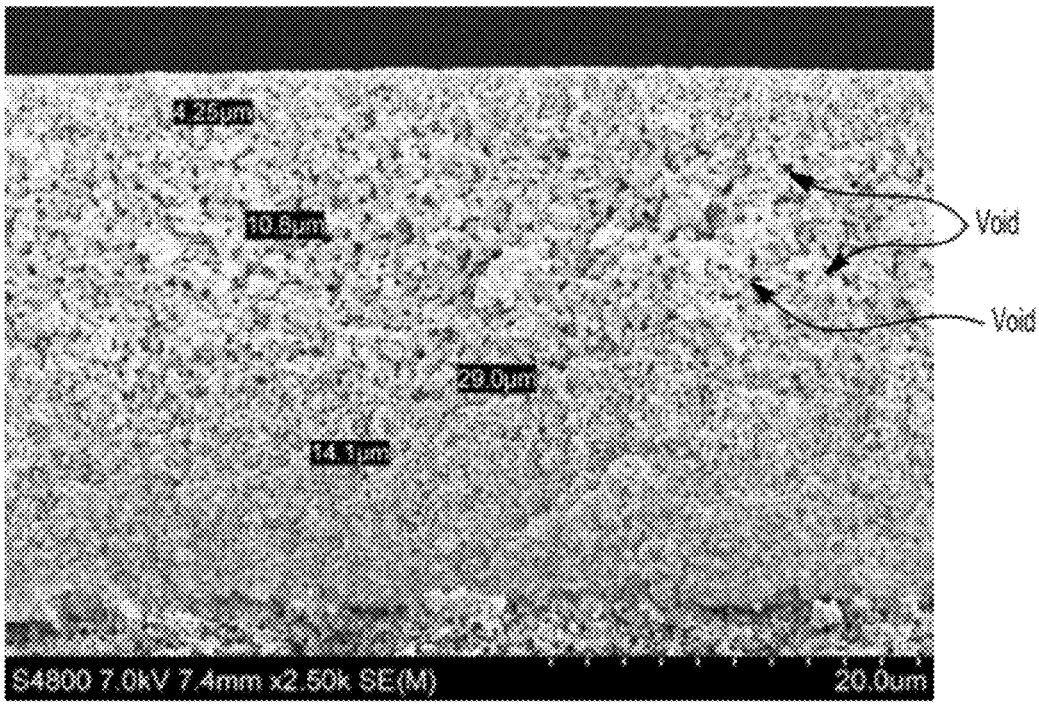

Scanning electron micrograph (SEM) images were taken of a cross section of the ink receiving layer of the Comparative Sample, Sample A, and Sample B after drying. These images are shown in FIGS. 4A, 4B, 5A, and 5B. FIGS. 4A and 4B are SEM images of the Comparative Sample upon exposure to mild drying conditions and harsh drying conditions, respectively. As shown in FIG. 4A, the structure of the ink receiving layer (which had a coating thickness of 23.6 μm) under mild drying conditions is relatively dense. In contrast, as shown in FIG. 4B, the coating thickness is about 29 μm, and the structure of the ink receiving layer under harsh drying conditions is much looser, where large voids are visible through the layer (a few of which are labeled on FIG. 4B, i.e., the black spaces adjacent the tips of the arrow heads at the ends of the "Void" leader lines).

Figure 5A:
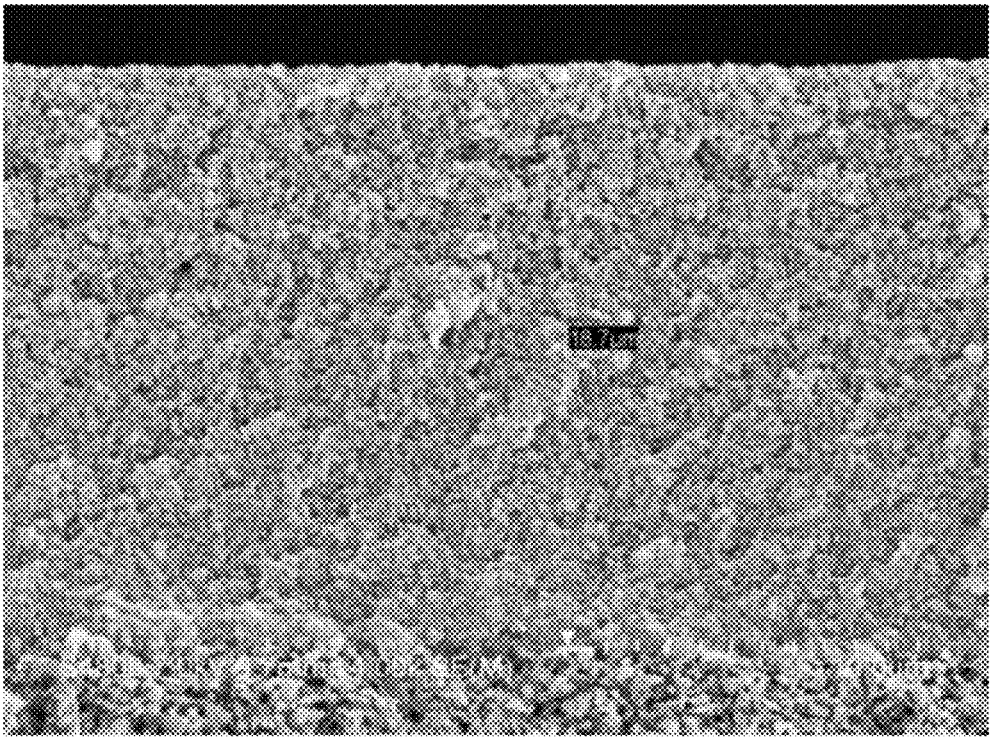
FIG. 5A is a SEM image showing a cross-section of an ink receiving layer including alumina nanoparticles, where the medium including the ink receiving layer was made under harsh drying conditions.
Figure 5B:
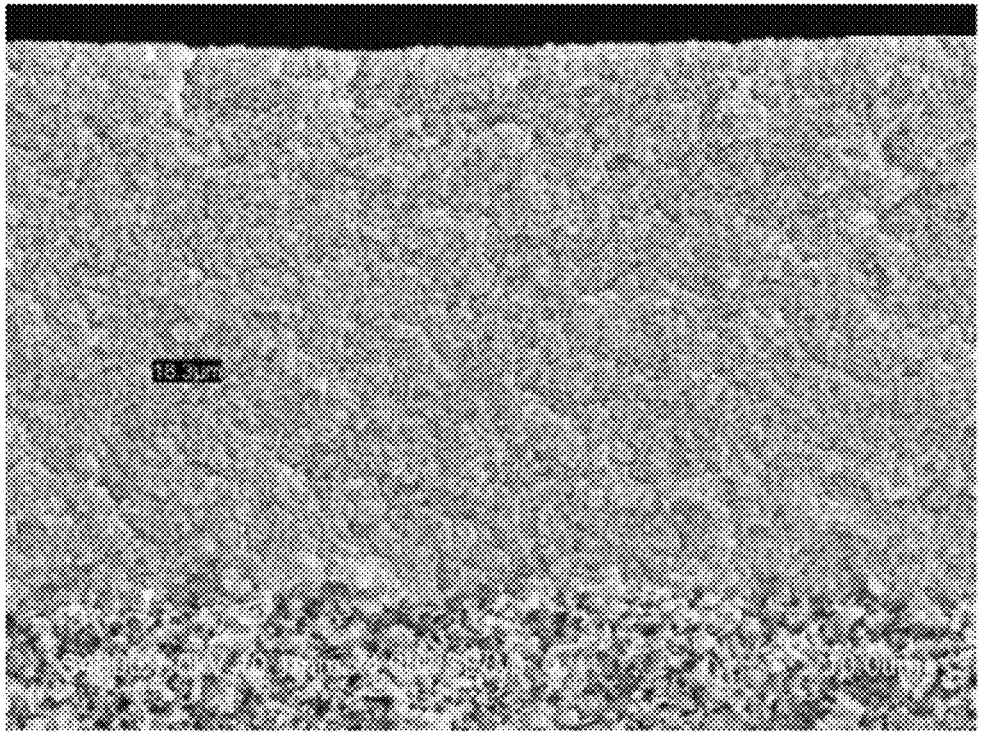
FIG. 5B is a SEM image showing a cross-section of an ink receiving layer including silica nanoparticles, where the medium including the ink receiving layer was made under harsh drying conditions.

FIG. 5A is an SEM image showing a cross-section of the ink receiving layer including alumina nanoparticles, where the medium including the ink receiving layer was made under harsh drying conditions. FIG. 5B is an SEM image showing a cross-section of the ink receiving layer including silica nanoparticles, where the medium including the ink receiving layer was also made under harsh drying conditions. Both of these SEM images show that the structure of the ink receiving layer is more dense (e.g., no large voids are visible in the images) than that of the ink receiving layer of the Comparative Sample (as shown in FIG. 4B).

It is to be understood that the ranges provided herein include the stated range and any value or sub-range within the stated range. For example, an amount ranging from about 15 nm to about 60 nm should be interpreted to include not only the explicitly recited amount limits of about 15 nm to about 60 nm, but also to include individual amounts, such as 25 nm, 45 nm, 55 nm, etc., and subranges, such as 30 nm to 50 nm, etc. Furthermore, when "about" is utilized to describe a value, this is meant to encompass minor variations (up to +/−5%) from the stated value.

It is further to be understood that, as used herein, the singular forms of the articles "a," "an," and "the" include plural references unless the content clearly indicates otherwise.

Additionally, the term "any of" when used in conjunction with the components making up the ink receiving layer 16, as recited herein, refers to cases where the ink receiving layer includes fumed silica and i) silica nanoparticles alone, ii) alumina nanoparticles alone, and iii) a mixture of silica nanoparticles and alumina nanoparticles.

While several examples have been described in detail, it will be apparent to those skilled in the art that the disclosed examples may be modified. Therefore, the foregoing description is not to be considered limiting.

What is claimed is:

1. An inkjet recording medium, comprising:

a substrate; and an ink receiving layer disposed on a surface of the substrate, the ink receiving layer including cationically-modified fumed silica having nanoparticles of any of alumina or silica mixed therein, the cationically-modified fumed silica being present in an amount ranging from about 60 wt % to about 90 wt % of a total amount of pigment present in the ink receiving layer, the alumina nanoparticles having an individual particle size ranging from about 15 nm to about 50 nm and being present in an amount ranging from about 10 wt % to about 40 wt % of the total amount of pigment present in the ink receiving layer, and the silica nanoparticles having an individual particle size ranging from about 5 nm to about 45 nm and being present in an amount ranging from about 10 wt % to about 30 wt % of the total amount of pigment present in the ink receiving layer;

wherein the ink receiving layer has a coating density that is equal to or greater than about 0.7 g/cc.

2. The inkjet recording medium as defined in claim 1 wherein the cationically-modified fumed silica has i) an individual particle size ranging from about 5 nm to about 80 nm, ii) an aggregated particle size ranging from about 80 nm to about 500 nm, and iii) a surface area of each individual particle ranging from about 150 $m^2/g$ to about 350 $m^2/g$.

3. The inkjet recording medium as defined in claim 1 wherein the cationically-modified fumed silica has a zeta potential ranging from about 20 mV to about 50 mV.

4. The inkjet recording medium as defined in claim 1 wherein the silica nanoparticles are a cationically-modified, amorphous colloidal silica pigment having a surface area ranging from about 110 $m^2/g$ to about 130 $m^2/g$, and wherein the alumina nanoparticles individually have a surface area ranging from about 150 $m^2/g$ to about 200 $m^2/g$.

5. The inkjet recording medium as defined in claim 1 wherein the cationically-modified fumed silica is present in an amount ranging from about 70 wt % to about 90 wt % of the total amount of pigment present in the ink receiving layer, and wherein the silica nanoparticles are present.

6. The inkjet recording medium as defined in claim 1 wherein the cationically-modified fumed silica is present in an amount ranging from about 60 wt % to about 90 wt % of the total amount of pigment present in the ink receiving layer, and wherein the alumina nanoparticles are present.

7. The inkjet recording medium as defined in claim 1 wherein the ink receiving layer further includes:

a surfactant present in an amount ranging from about 0.1 wt % to about 0.3 wt % of the ink receiving layer;

a humectant present in an amount ranging from about 0.5 wt % to about 1.5 wt % of the ink receiving layer;

a cross-linking agent present in an amount ranging from about 2 wt % to about 3 wt % of the ink receiving layer; and a binder present in an amount ranging from about 10 wt % to about 20 wt % of the ink receiving layer.

8. The inkjet recording medium as defined in claim 1 wherein the coat weight of the ink receiving layer ranges from about 10 gsm to about 30 gsm.

9. The inkjet recording medium as defined in claim 1 wherein the substrate is chosen from cellulose papers, papers including synthetic fibers, polymeric films, or combinations thereof.

10. The inkjet recording medium as defined in claim 1, further comprising a base layer disposed on the substrate, underneath the ink receiving layer, the base layer including at least a pigment and a binder.

11. The inkjet recording medium as defined in claim 1 wherein the silica nanoparticles are present and wherein the silica nanoparticles are cationic colloidal silica nanoparticles.

12. A method of making an inkjet recording medium, comprising:

forming an ink receiving layer on a surface of a substrate, the ink receiving layer including cationically-modified fumed silica having nanoparticles of any of alumina or silica mixed therein, the cationically-modified fumed silica being present in an amount ranging from about 60 wt % to about 90 wt % of a total amount of pigment present in the ink receiving layer, the alumina nanoparticles having an individual particle size ranging from about 15 nm to about 50 nm and being present in an amount ranging from about 10 wt % to about 40 wt % of the total amount of pigment present in the ink receiving layer, and the silica nanoparticles having an individual particle size ranging from about 5 nm to about 45 nm and being present in an amount ranging from about 10 wt % to about 30 wt % of the total amount of pigment present in the ink receiving layer, the forming of the ink receiving layer including:

depositing the cationically-modified fumed silica having the nanoparticles mixed therein to form a layer; and drying the layer by exposing the layer to heat having a temperature greater than 100° C.;

wherein upon drying of the layer, the layer has a coating density equal to or greater than about 0.7 g/cc.

13. The method as defined in claim 12, further comprising forming a base layer on the surface of the substrate before the ink receiving layer is formed, and then forming the ink receiving layer on the base layer.

14. The method as defined in claim 12 wherein the drying further comprises exposing the layer to the temperature for less than 15 seconds while a moisture content of the layer falls within a range of about 4% to about 7%, and wherein a water evaporation rate during drying is equal to or greater than about 4 g/($m^2$·sec).

15. An inkjet recording system, comprising:

an inkjet recording medium, including:

a substrate;

a base layer disposed on the substrate; and an ink receiving layer disposed on the base layer, the ink receiving layer including cationically-modified fumed silica having nanoparticles of any of alumina or silica mixed therein, the cationically-modified fumed silica being present in an amount ranging from about 60 wt % to about 90 wt % of a total amount of pigment present in the ink receiving layer, the alumina nanoparticles having an individual particle size ranging from about 15 nm to about 50 nm and being present in an amount ranging from about 10 wt % to about 40 wt % of the total amount of pigment present in the ink receiving layer, and the silica nanoparticles having an individual particle size ranging from about 5 nm to about 45 nm and being present in an amount ranging from about 10 wt % to about 30 wt % of the total amount of pigment present in the ink receiving layer, wherein the ink receiving layer has a coating density that is equal to or greater than about 0.7 g/cc; and an inkjet printing system, including an inkjet printer to deposit an ink onto the inkjet recording medium to form a print.

16. The inkjet recording system as defined in claim 15 wherein the silica nanoparticles are present and wherein the silica nanoparticles are cationic colloidal silica nanoparticles.

* * * * *